US006179916B1

(12) United States Patent
Flower

(10) Patent No.: US 6,179,916 B1
(45) Date of Patent: Jan. 30, 2001

(54) APPARATUS FOR AND METHOD OF COATING PARTICULATES

(76) Inventor: Arnold B. Flower, 164 Wilson Drive, Milton, Ontario (CA), L9T 3J9

( * ) Notice: Under 35 U.S.C. 154(b), the term of this patent shall be extended for 0 days.

(21) Appl. No.: 09/134,532

(22) Filed: Aug. 14, 1998

(51) Int. Cl.[7] ..... B05C 3/00
(52) U.S. Cl. ..... 118/417; 366/147; 366/297
(58) Field of Search ..... 366/147, 300, 366/297, 162.1, 134, 160.1, 181.4; 118/20, 58, 417, 663; 34/181; 177/70, 68, 71; 427/445, 372.1, 242, 212

(56) References Cited

U.S. PATENT DOCUMENTS

| | | | | |
|---|---|---|---|---|
| 2,917,395 | | 12/1959 | Csanyi | 106/122 |
| 3,141,792 | * | 7/1964 | Lachman et al. | 118/20 X |
| 3,645,813 | | 2/1972 | Pelikan et al. | 156/62.4 |
| 4,245,580 | * | 1/1981 | Okawara | 118/20 X |
| 4,619,381 | | 10/1986 | Wurtz | 222/272 |
| 4,644,665 | * | 2/1987 | Naunapper et al. | 118/663 X |
| 4,678,046 | * | 7/1987 | Mosher | 177/1 |
| 4,791,735 | | 12/1988 | Forberg | 34/181 |
| 5,582,643 | * | 12/1996 | Takei et al. | 118/20 X |
| 5,753,868 | * | 5/1998 | Diem | 177/70 |

* cited by examiner

*Primary Examiner*—Richard Crispino
*Assistant Examiner*—George R. Koch, III
(74) *Attorney, Agent, or Firm*—Robert F. Delbridge

(57) ABSTRACT

The invention provides an apparatus and method for creating dry coated particulates from particulates and a liquid. A mixer receives the particulates and liquid and creates a wet mixture which is then subjected to hot air from a hot air generator to dry the mixture and produce the dry coated particulates. In a preferred form the apparatus includes a floating coupling between the mixer and the generator to permit some relative movement, and load cells are used to control the amount of particulates loaded into the mixer. There is similar control of the liquid and a control console is provided to receive data and send instructions to cause the apparatus to cycle through repetitive batch processes in a continuous process. The mixer preferably includes structure to cause the hot air to enter the mixture as it moves downwardly in the mixer for enhanced drying.

12 Claims, 5 Drawing Sheets

APPARATUS FOR AND METHOD OF COATING PARTICULATES

FIELD OF THE INVENTION

The field of the invention relates to an apparatus having a mixer for coating particulates using a liquid to create a wet mixture which is then dried to create coated particulates. The apparatus is controlled to cycle repetitively through a series of similar batch processes in a continuous process.

BACKGROUND OF THE INVENTION

Commercial manufacturing processes often involve the use of particulates which are embedded in a mixture. One example would be brake pads for vehicles in which particulates of high friction material are embedded in a supporting material. In some cases the particulates will not naturally bond to the supporting material so that it is necessary to coat the particulates with an intermediate material which is compatible with both the particulates and the supporting material to facilitate bonding.

Apparatus exists for coating particulates in which particulates are mixed with liquid in a mixing chamber to coat the particulates and the resulting wet mixture is conveyed to a drying station to be dried. A problem with this process is that the particulates tend to agglomerate when coated with the liquid resulting in wet mixtures which are difficult to transport from the mixing chamber to the drying station. It would therefore be advantageous to be able to handle such materials in one location where the materials are first mixed to coat the particulates and then dried for subsequent handling.

Accordingly, it is an object of the invention to provide an improved apparatus for coating particulates with a liquid, and then drying the resulting wet mixture in the same location. It is also an object of the invention to produce apparatus capable of coating and drying consecutive batches of material in a continuous or automatic process.

SUMMARY OF THE INVENTION

Apparatus is provided for creating a dry coating on particulates from a liquid source. In one of its aspects the apparatus includes a mixer for receiving particulates and liquid and operable to create a wet mixture. Load cells are coupled to the mixer to measure the amount of particulates fed into the mixer and a liquid measure is also coupled to the mixer for controlling the amount of liquid to be fed to the mixer for mixing with the particulates. A hot air generator is connected to the mixer by an air duct assembly to direct hot air through the mixer for drying the wet mixture. The air duct assembly includes a floating coupling to permit limited relative movement between the mixer and the hot air generator caused by temperature changes and movement of the mixer on the load cells as the particulates are introduced into the mixer without significantly affecting the signal created by the load cells in response to the introduction of the particulates. A central station is coupled to collect data and send signals for conducting a batch process by sequentially filling the mixer, mixing the particulates and liquid to form said mixture, drying the mixture and discharging the resulting dry coated particulates.

In another of its aspects the invention provides apparatus having a mixer for receiving particulates and liquid and operable to create a wet mixture. A hot air generator is connected to the mixer by an air duct assembly to direct hot air through the mixer for drying the wet mixture. The mixer has a housing including parallel side walls, at least one mixing rotor extending parallel to the side walls, and a cavity extending along the one of the side walls adjacent the downward travel of the rotor. The cavity has a bottom opening and is coupled to the air duct assembly to receive hot air and direct it through the bottom opening into the wet mixture to travel downwardly with the mixture and rotor for enhanced drying.

These and other aspects of the invention will be better understood with reference to the following description taken in combination with the drawings.

BRIEF DESCRIPTION OF THE DRAWINGS

A preferred embodiment of the invention will now be described with reference to the drawings in which.

DETAILED DESCRIPTION OF THE PREFERRED EMBODIMENT(S)

Figure 1:
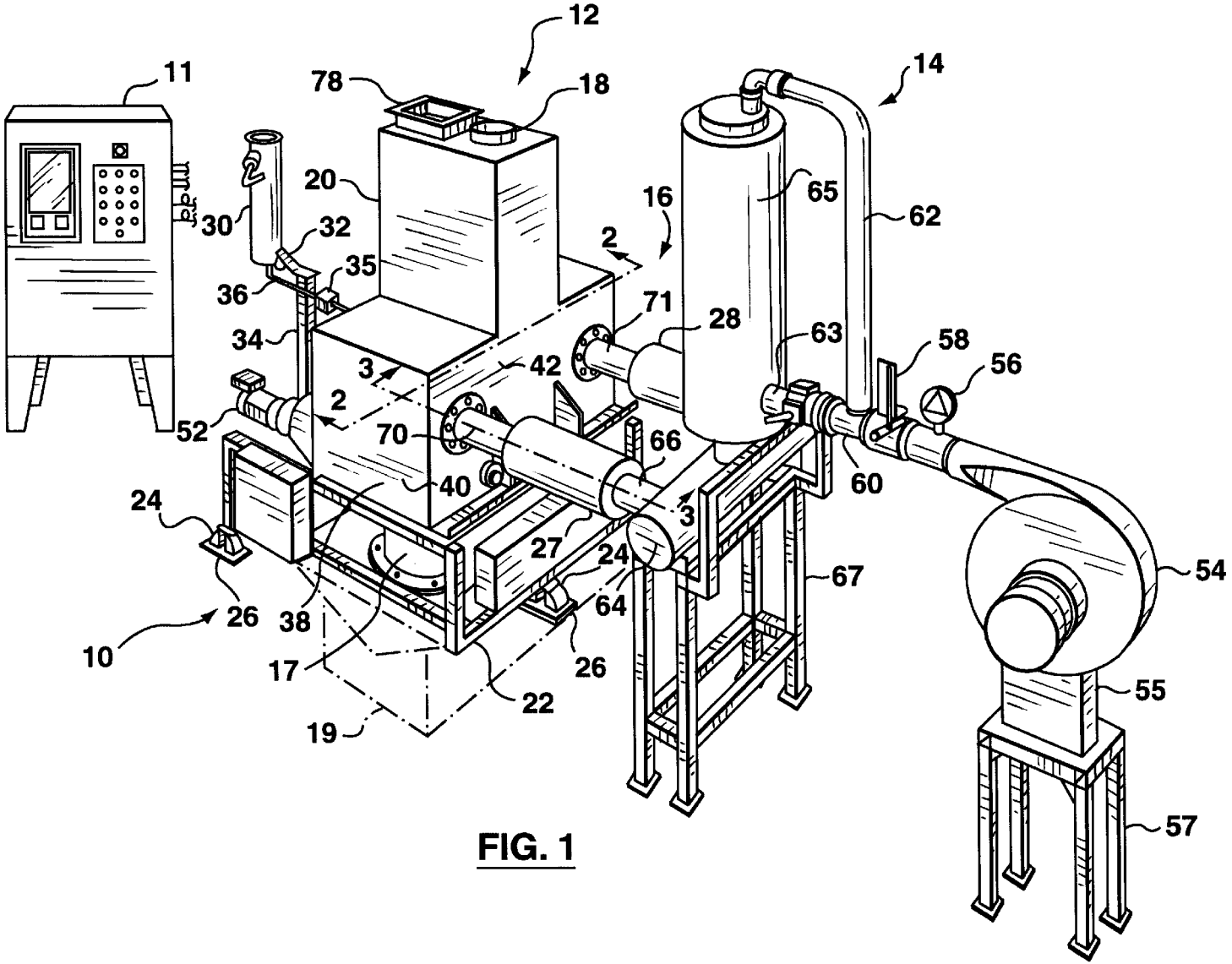
FIG. 1 is an isometric view of apparatus according to the preferred embodiment of the invention and including a mixer and a hot air generator coupled to the mixer by a duct assembly.

Reference is first made to FIG. 1 which shows an apparatus designated generally by reference numeral 10, for coating particulates and drying the resulting mixture. The apparatus 10 is operated in accordance with a pre-established program to process material in a series of batches continuously. The program is executed using conventional pneumatic and electrical devices (not shown to avoid unnecessary complexity) by a control station 11, and includes a mixer, designated generally by reference numeral 12, for receiving and mixing together metered quantities of particulates and liquid to coat the particulates. After coating, the resulting wet mixture is dried in the mixer 12 using hot air under pressure received from a hot air generator 14. The hot air is supplied to the mixer 12 through an air duct assembly 16 and after drying, coated particulates are discharged from the mixer 12 through a discharge outlet 17 into a collector bin 19. The apparatus is then ready for a new batch. Metered amounts of particulates and liquid are automatically metered into the mixer 12 to undergo processing. These batch processes are repetitive to create an essentially continuous process.

The coating and drying apparatus 10 will now be described in more detail followed by a description of the steps with reference to FIG. 4.

Particulates are metered into the mixer 12 through a particulate inlet 18 in an outlet plenum 20 of the mixer 12. The mixer 12 rests on rigid frame 22 supporting the mixer 12, and the frame 22 has feet 24 below which are disposed load cells 26 set up to measure the weight of particulates which have entered the mixer 12. The dead weight of the mixer above the load cells 26 will of course remain constant during weighing. However, the nature of the load cells is such that the mixer must move downwardly as the particulates are added in order to give the necessary deflection on the load cells to result in an analog signal from the load cells. It is therefore important to provide an air duct assembly 16 which will have no effect (or a predictable effect) on the weighing.

To do this, the air conduit assembly 16 between the mixer 12 and the dryer 14 includes a pair of floating couplings 27, 28 which will be described in further detail below. These couplings allow the mixer 12 to move downwardly on the load cells 26, relatively independently of the hot air generator 14 when particulates are being added to the mixer 12.

Next, liquid is added to the mixer 12. A liquid chamber 30 receives a predetermined amount of liquid as determined by a liquid scale which is in the form of a load cell 32 disposed between the liquid chamber 30 and a chamber support 34. This measured amount of liquid is discharged through a valve 35 into the mixer 12 via a liquid conduit 36 which is coupled to a conventional manifold (not shown) in the mixer 12 and having spray nozzles through which liquid is discharged onto particulates in the mixer 12. The spray nozzles are preferentially arranged to spray liquid on the particulates rather than on the internal surfaces of the mixer 12.

Figure 2:
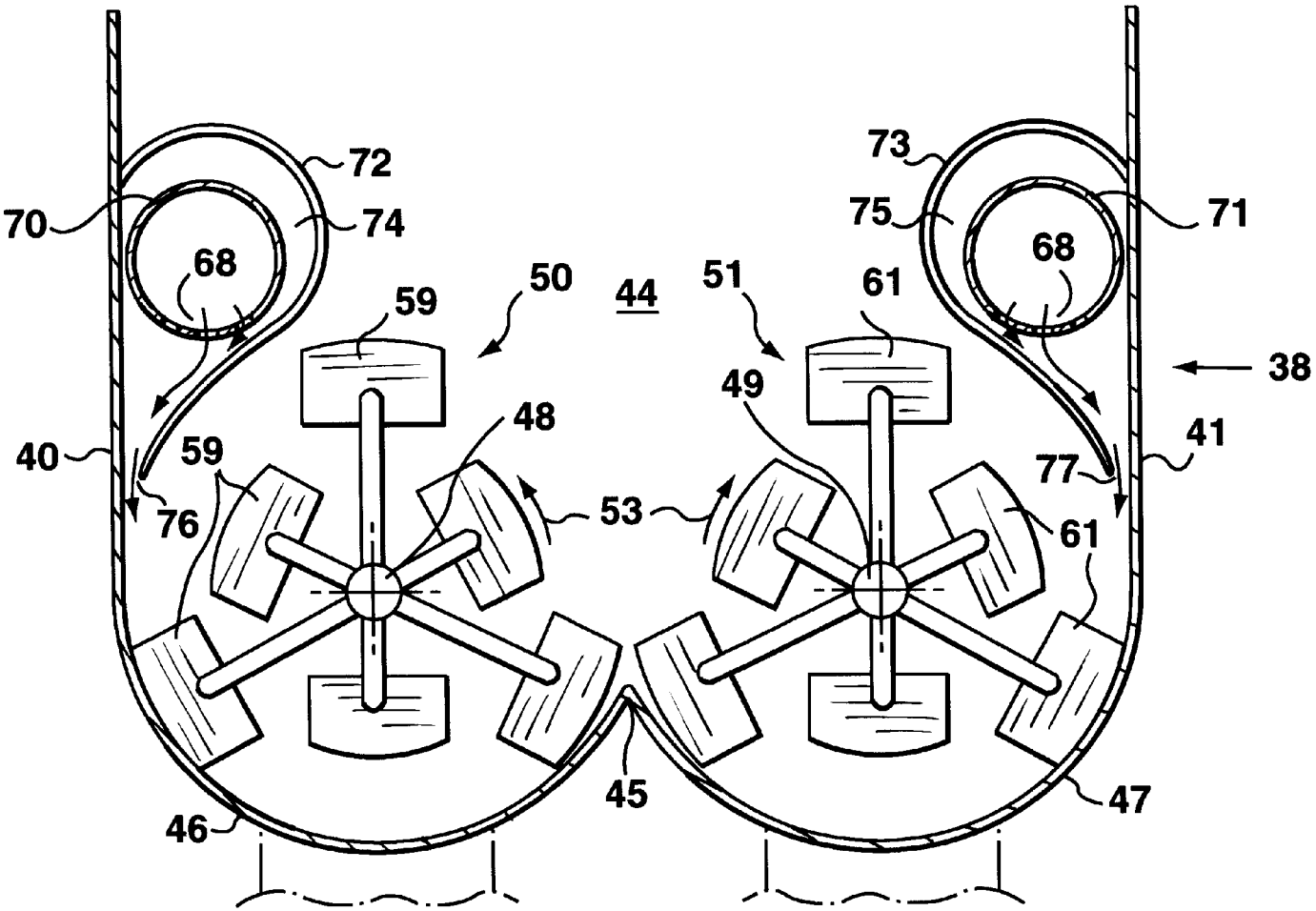
FIG. 2 is a sectional view of the apparatus of FIG. 1 to a larger scale and taken generally on line 2—2 of FIG. 1 to show internal details of the mixer.

Referring next to FIG. 2, the mixer 12 has a housing designated generally by numeral 38 into which particulates and liquid are added. The housing 38 includes upright side walls 40, 41, and upright end walls 42 (FIG. 1) and 44 arranged orthogonally with respect to the side walls 40, 41 and a pair of cylindrically curved bottom walls 46, 47 extending tangentially from the respective side walls 40, 41 to meet at a central ridge 45 and extending between the end walls 42, 44 in a longitudinal direction. The bottom walls 46, 47 are defined from respective longitudinal rotor axes 48, 49 and mixing rotors 50, 51 are mounted on the end walls 42, 44 for rotation. Part of a suitable drive system is seen at 52 in FIG. 1 to drive the rotors 50, 51 in opposite directions as indicated in FIG. 2 by arrows 53 and include respective sets of mixing vanes 59, 61.

After the particulates and liquid have been added to the mixer in selected amounts, the mixer is run to mix and cause coating of liquid on the particulates. Once this coating process is completed, the resulting wet mixture is exposed to hot air from the hot air generator 14.

As can be seen with reference again to FIG. 1, the hot air generator 14 includes an air blower 54 for creating a stream of pressurized air drawn from an inlet 55 supported on a stand 57. The air stream is conducted via a gauge 56 and a throttling valve 58 to a junction 60 where some of the air passes upwardly through a duct 62 for use in combustion, and the remainder passes through a duct 63 before entering a heat exchanger forming part of a furnace 65 supported on a suitable stand 67. The heated air then passes into a transversely mounted manifold 64 which is part of the air duct assembly 16.

The manifold 64 feeds a pair of ducts 66 (one of which is seen) to feed air to the pair of floating couplings 27, 28 which in turn feed air to connecting ducts 70, 71 attached to the housing 38 of the mixer 12. As seen in FIG. 2, these ducts extend into the housing and have bottom openings 68 for directing air (as indicated by the arrows) into respective deflectors 72, 73. These deflectors form longitudinally extending cavities 74, 75 within the housing 38 and define elongate bottom openings 76, 77 so that exiting hot air is made to move downwardly along the inner surface of the housing 38 to become entrapped in the mixture as it moves downwardly below the openings 76, 77 driven by the rotors 50, 51. Once the hot air has been spent, it will exit from the housing 38 through the outlet plenum 20 which leads to a duct (not shown) coupled to a connector 78 at the top of the outlet plenum, 20 (FIG. 1).

It will be appreciated that the heat carried by the air must be sufficient to dry the particulates in a predetermined time frame.

Figure 3:
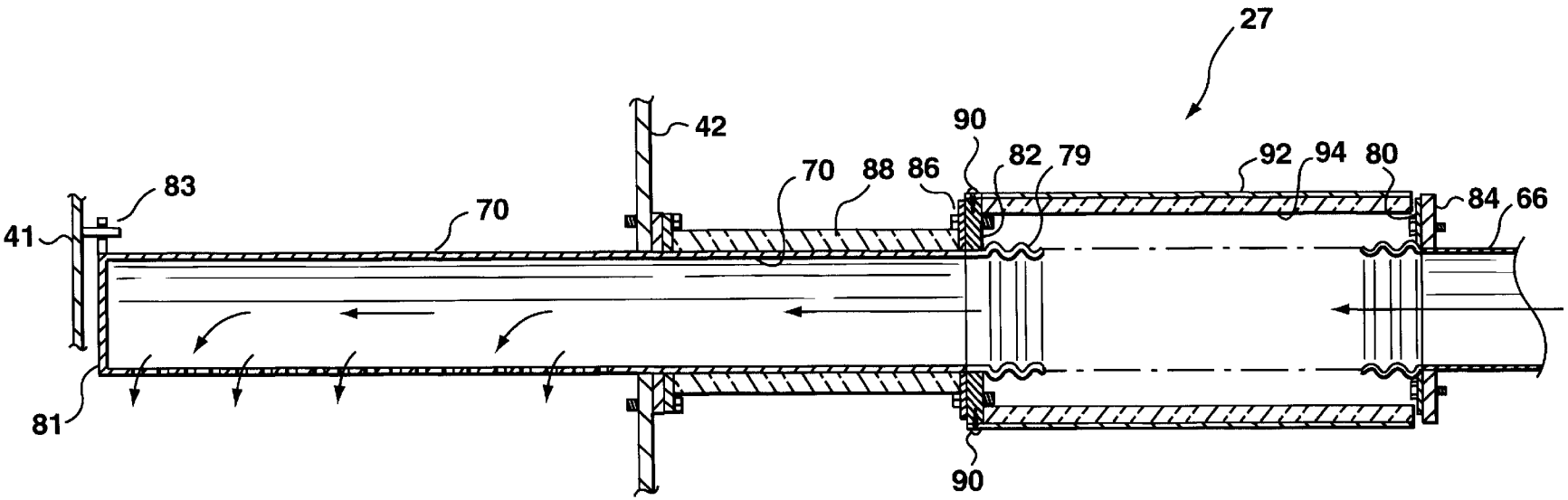
FIG. 3 is a sectional view of a portion of the apparatus of FIG. 1 to a larger scale and taken generally on line 3—3 of FIG. 1 to show a floating coupling between the mixer and the air generator.

Reference is next made to FIG. 3 to describe the floating coupling 27 which is typical also of coupling 28. A stainless steel thin-walled corrugated tube 79 extends between the integral flanges 80, 82 which are secured to respective flanges 84, 86 on ducts 66, 70. Exemplary insulation 88 on duct 70 could be applied also to duct 66.

The flange 82 is sufficiently thick to receive radial screws 90 to retain a cylindrical sleeve 92 at one end leaving the other end unsupported. The radial space inside the sleeve accommodates insulation 94 and this also is free at an end remote from the screws 90. As a result, the floating coupling 27 permits the ducts 66 and 70 to move longitudinally, transversely and angularly with respect to one another as a result of assembly misalignment, temperature fluctuations, and loading and unloading of the mixer 12.

The corrugated tube 79 accommodates movements with minimal resistance which is well within the acceptable limits of loading variations reported by the load cells. As a result, the effect of the floating coupling 27 is effectively transparent to the overall accuracy of the apparatus 10.

As also seen in FIGS. 2 and 3 the duct 70 extends inside the cavity 74. In order to reduce the risk of stress caused by expansion and contraction, the duct 70 is fixed in end wall 42 but is arranged to float at a blind end 81 on a pin 83 attached to end wall 41. A similar arrangement is used for duct 71.

Figure 4A:
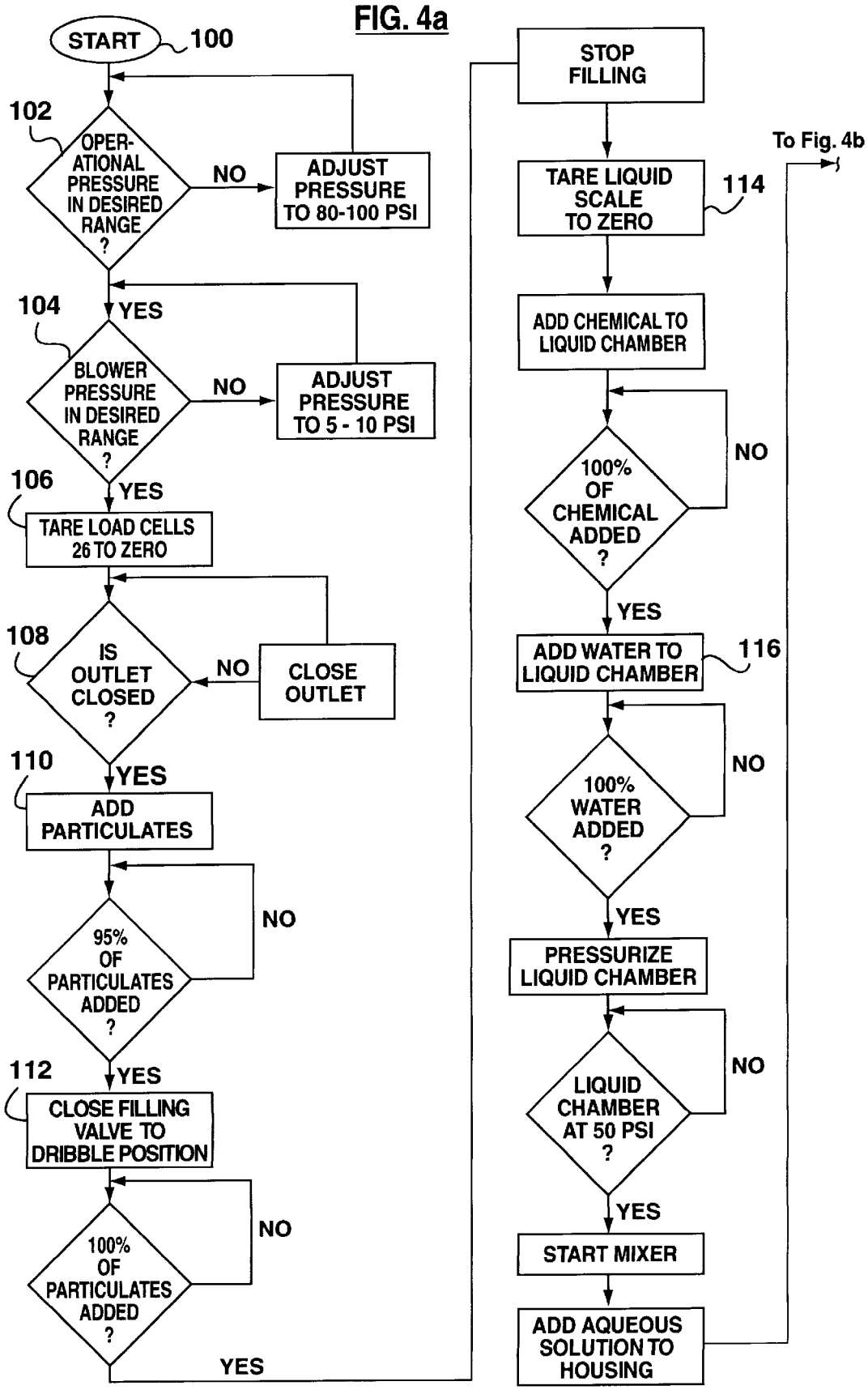
FIG. 4 (made up of parts 4*a* and 4*b* on adjacent sheets) is a flow chart of the steps followed by the apparatus of FIG. 1 in coating particulates, drying the resulting wet mixture, and discharging dry coated particulates before receiving another batch of materials.
Figure 4B:
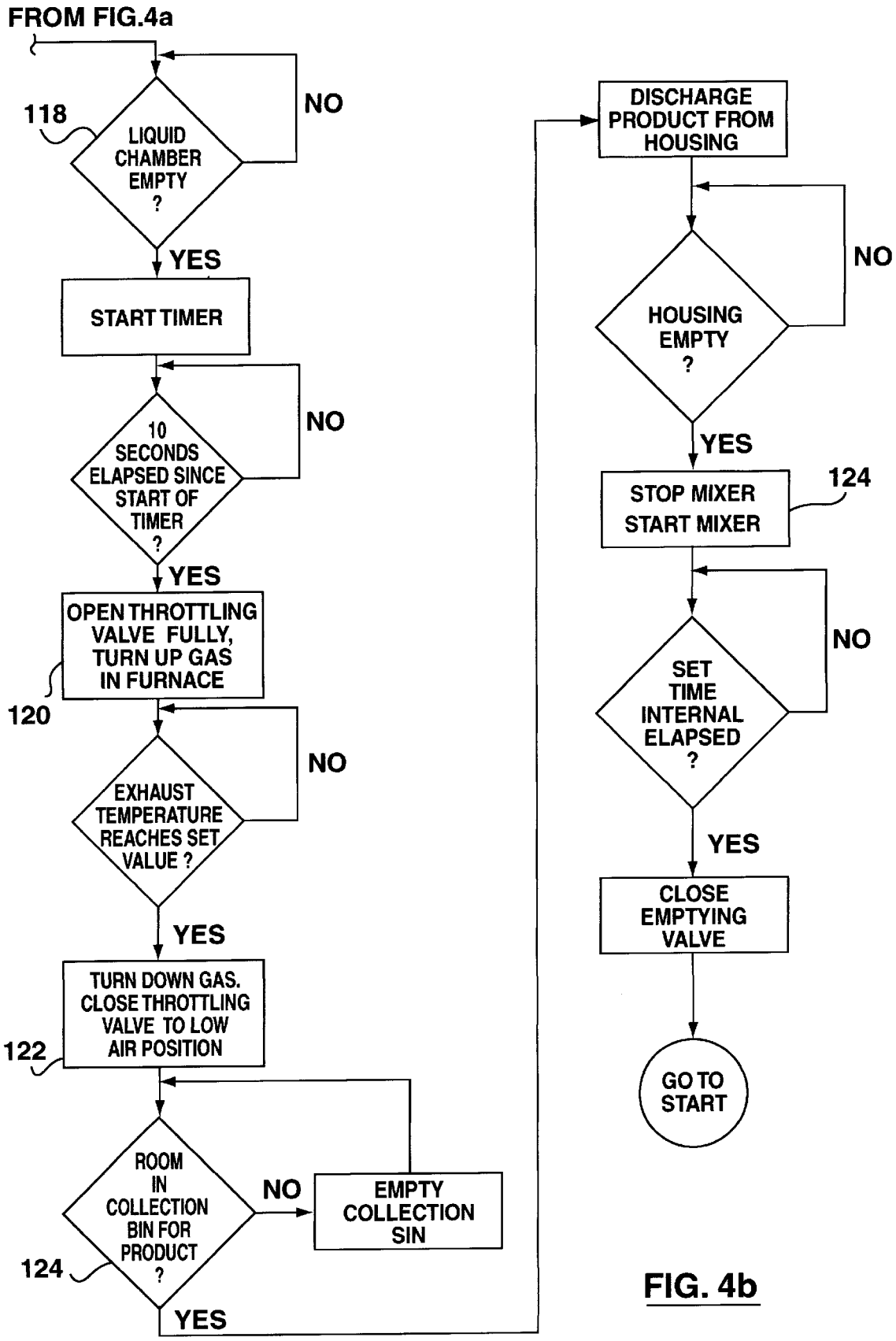

Reference is next made to FIGS. 1 and 4 to describe the sequence of steps in the process of coating particulates. As already mentioned, the continuous process is based on a series of batches. In other words, as each batch is completed the apparatus is automatically re-initialized ready to work on another similar batch.

At the start 100 of each batch, a series of checks are conducted. First there must be a supply of compressed air in the range 80–100 psi to operate the pneumatic actuators on hoppers, etc. This is checked at 102 and then the supply air for the furnace 65 is checked at 104 to ensure that the blower is supplying air at no less than 5 psi, and that the furnace is operating in a standby mode.

Next at 106 the load cells 26 are tared to zero and the discharge outlet 17 is checked at 108 to ensure that it is fully closed.

The apparatus is now ready to receive particulates and this is done in two stages. Initially a valve associated with particulate inlet 18 is opened completely and the load cells 26 respond by partially closing the valve when about 95% of a batch of particulates has been poured into the mixer 12. The remaining 5% is dribbled into the mixer through the partly closed valve to give the load cells and the control system sufficient sensitivity to shut off the flow of particulate when 100% is reached. These steps are indicated at 110 and 112 in FIG. 4. At this point the mixer has yet to start.

Next, the load cell 32 under the liquid chamber 30 is tared to zero at 114. Once a predetermined amount of liquid chemical has been added to the liquid chamber 30, as measured by the liquid load cell 32, water is then added at 116 to the liquid chamber 30 until a sufficient amount has been added to provide a required aqueous chemical solution. Immediately thereafter, the liquid chamber 30 is pressurized to 50 psi and the mixer 12 is started causing the rotors 50, 51 to rotate to bring the particulates into motion. The liquid valve 35 is then opened allowing the pressurized aqueous liquid solution to flow from the chamber 30, through the liquid conduit 36, and into the housing 38 via the spray nozzles arranged along the manifold.

The liquid load cell checks at 118 to detect when the liquid chamber 30 has emptied and the rotors 50, 51 rotate for an initial 10 seconds before a drying phase of the batch operation begins at 120. This phase is started by opening the throttling valve 58 and providing a full flow of gas into the furnace 65. The heated air is then conveyed to the housing 38 via the air duct assembly 16 to dry the wet mixture of particulates and liquid which is now in constant motion due to the rotation of the rotors 50, 51. This process continues until the temperature of exhaust air passing through the outlet plenum 20 increases indicating that the mixture has dried. The gas to the furnace 65 is then turned down and the throttling valve 58 is activated to return to the low air position, thereby ending the drying phase as indicated at 122.

A sensor associated with the collection bin 19 (shown in ghost outline in FIG. 1) indicates whether or not there is room in the collection bin for receiving the batch of dried product from the housing 38 (see 124). If there is room, a trap door under the discharge outlet 17 is opened while the rotors 50, 51 continue to rotate to facilitate discharge of the dried and coated particulates from the housing 38.

If the collection bin is too full to receive the new batch of particulates, the bin will be emptied prior to discharging the new batch.

The batch process is completed when the load cells 26 return to the tared zero set at the beginning of the batch (or within a set limit). The rotors 50, 51 are then stopped at 124 and a short predetermined period of time is started to allow the apparatus 10 to cool down and to ensure final emptying. The batch process returns to "start" at 100 to begin a new batch operation automatically thereby continuing the process.

It will be appreciated that the foregoing description is by way of example only and is not meant to limit the scope of the appended claims.

For example, instead of the stainless steel corrugated tube 79, each air duct assembly 16 may include any other kind of flexible connection as would permit the flow of air therethrough and relative movement between the mixer 12 and the hot air generator 14 such that load cells 26 remain useful in accurately measuring the amount of particulates entering the housing 38 during each batch operation. Also the load cell systems could be varied. In particular the amount of liquid could be controlled volumetrically.

All such modifications are within the scope of the invention as described and claimed.

What is claimed is:

1. Apparatus for creating a dry coating from a liquid source on particulates, the apparatus including;

a mixer for receiving particulates and coating liquid and operable to create a wet mixture;

load cells coupled to the mixer to measure the amount of particulates fed into the mixer;

liquid measuring means coupled to the mixer for controlling the amount of coating liquid to be fed to the mixer for mixing with the particulates;

a hot air generator;

an air duct assembly coupling the mixer to the hot air generator to direct hot air through the mixer for drying said wet mixture, the air duct assembly including a floating coupling to permit limited relative movement between the mixer and the hot air generator caused by temperature changes and movement of the mixer on the load cells due to the introduction of particulates into the mixer without significantly affecting the signal created by the load cells in response to the introduction of the particulates; and a control station for collecting data and sending signals to conduct a batch process by sequentially filling the mixer, mixing the particulates and liquid to form said wet mixture, drying the mixture and discharging the resulting dry coated particulates.

2. Apparatus as claimed in claim 1 in which the control station automatically commences a new batch process on completion of a previous batch process.

3. Apparatus as claimed in claim 1 in which the floating coupling includes a thin-walled corrugated tube coupled at the respective ends of the tube to the mixer and the hot air generator.

4. Apparatus as claimed in claim 1 in which the mixer includes feet and in which the load cells are under the feet.

5. Apparatus as claimed in claim 1 in which the mixer includes a housing having parallel side walls, at least one mixing rotor extending horizontally and parallel to the side walls, and a cavity extending along one of the side walls adjacent and above the downward travel of the rotor, the cavity having a bottom opening and being coupled to the air duct assembly to receive hot air and direct said hot air through the bottom opening into said wet mixture to travel downwardly with the mixture and rotor for enhanced drying.

6. Apparatus as claimed in claim 1 in which the mixer includes a housing having parallel side walls, a pair of mixing rotors extending horizontally and parallel to the side walls for rotation in opposite directions such that the downward travel of the rotors is adjacent the respective side walls, a pair of cavities extending along the respective side walls adjacent and above the mixing rotors, and the cavities having bottom openings and being coupled to the air duct assembly to receive hot air and direct said hot air through the bottom openings into said mixture to travel downwardly with the mixture and rotors for enhanced drying.

7. Apparatus as claimed in claim 6 in which the floating coupling includes a thin-walled corrugated tube coupled at the respective ends of the tube to the mixer and the hot air generator.

8. Apparatus as claimed in claim 6 in which the mixer includes feet and in which the load cells are under the feet.

9. Apparatus for creating a dry coating from a liquid source on particulates, the apparatus including:

a mixer for receiving particulates and liquid and operable to create a wet mixture;

a hot air generator;

an air duct assembly coupling the mixer to the hot air generator to direct hot air through the mixer for drying said wet mixture, the mixer having a housing including parallel side walls, at least one mixing rotor extending horizontally parallel to the side walls, and a cavity extending along one of the side walls adjacent and above downward travel of the rotor, the cavity having a bottom opening and being coupled to the air duct assembly to receive hot air and direct said hot air through the bottom opening into said mixture to travel downwardly with the mixture and rotor for enhanced drying, said air duct assembly including at least one floating coupling to accommodate relative movement and minor misalignment between the mixer and the hot air generator.

10. Apparatus as claimed in claim 9 in which the floating coupling includes a thin-walled corrugated tube coupled at the respective ends of the tube to the mixer and the hot air generator.

11. Apparatus for creating a dry coating from a liquid source on particulates, the apparatus including:

a mixer for receiving particulates and liquid and operable to create a wet mixture;

a hot air generator;

an air duct assembly connecting the hot air generator to the mixer for transmitting hot air from the generator to the mixer; and the mixer having a housing including parallel side walls, a pair of mixing rotors extending parallel to the side walls for rotation in opposite directions such that the downward travel of the rotors is adjacent the respective side walls, a pair of cavities extending along the respective side walls adjacent and above the mixing rotors, the cavities having bottom openings and being coupled to the air duct assembly to receive hot air and direct said hot air through the bottom openings into said mixture to travel downwardly with the mixture and rotors for enhanced drying, said air duct assembly including at least one floating coupling to accommodate relative movement and minor misalignment between the mixer and the hot air generator.

12. Apparatus as claimed in claim 11 in which at least one floating coupling includes a thin-walled corrugated tube coupled at the respective ends of the tube to the mixer and the hot air generator.

* * * * *